US006138330A

United States Patent [19]

Galbreath

[11] Patent Number: 6,138,330

[45] Date of Patent: Oct. 31, 2000

[54] SAFETY SNAP BUCKLE HAVING BLOCKING ACTION

[76] Inventor: John Alexander Galbreath, 2516 Chestnut Woods Ct., Reisterstown, Md. 21136

[21] Appl. No.: 09/248,758

[22] Filed: Feb. 12, 1999

[51] Int. Cl.[7] ..... A44B 11/26

[52] U.S. Cl. ..... 24/625

[58] Field of Search ..... 24/615, 616, 625, 24/614

[56] References Cited

U.S. PATENT DOCUMENTS

| | | | |
|---|---|---|---|
| 4,150,464 | 4/1979 | Tracy | 24/77 R |
| 4,569,106 | 2/1986 | Lovato | 24/615 |
| 4,672,725 | 6/1987 | Kasai | 24/625 |
| 4,688,337 | 8/1987 | Dillner et al. | 24/616 |
| 4,793,032 | 12/1988 | Crowle | 24/615 |
| 4,825,515 | 5/1989 | Wolterstorff, Jr. | 24/625 |
| 4,912,950 | 4/1990 | Crowle | 70/58 |
| 4,987,661 | 1/1991 | Kasai | 24/625 |
| 5,119,532 | 6/1992 | Tanaka | 24/641 |
| 5,131,122 | 7/1992 | Lovato | 24/625 |
| 5,144,725 | 9/1992 | Krauss | 24/625 |
| 5,291,641 | 3/1994 | Morino | 24/625 |
| 5,311,649 | 5/1994 | Suh | 24/625 |
| 5,383,257 | 1/1995 | Krauss | 24/625 |
| 5,419,020 | 5/1995 | Murai | 24/625 |
| 5,438,737 | 8/1995 | Anscher | 24/630 |
| 5,459,910 | 10/1995 | Anscher | 24/625 |
| 5,548,879 | 8/1996 | Wu | 24/625 |
| 5,551,131 | 9/1996 | Anscher | 24/614 |
| 5,774,956 | 7/1998 | Wigger | 24/625 |
| 5,845,376 | 12/1998 | Tung | 24/625 |

*Primary Examiner*—James R. Brittain

[57] ABSTRACT

The device is a snap buckle with a safety feature—a blocking element 16 which blocks the action of the side catch arms 11*a*&*b* and prevents the buckle from being inadvertently disengaged.

A male plug 10, having side catch arms 11*a*&*b* and a central member 12, forms one part of the device. A female socket 13, having openings 14*a*&*b*, a depressible member 15, and a blocking element 16 forms the other part of the device.

To engage, plug 10 and socket 13 are urged together. Side catch arms 11*a*&*b* ride over blocking element 16 to engage openings 14*a*&*b*, and are then blocked from disengagement by blocking element 16. To disengage, depressible member 15 is depressed to disable the blocking action of blocking element 16, and side catch arms 11*a*&*b* are then pressed inward to disengage said side catch arms 11*a*&*b* from socket 13.

20 Claims, 16 Drawing Sheets

SAFETY SNAP BUCKLE HAVING BLOCKING ACTION

CROSS-REFERENCES TO RELATED APPLICATIONS

Not Applicable.

1. Field of the Invention

This invention is in the area of snap buckles, specifically a snap buckle with a safety feature that prevents inadvertent or unwanted release.

2. Description of the Related Art

Snap buckles are known in the art, beginning with U.S. Pat. No. 4,150,464 to Tracy. Variations on this buckle type include U.S. Pat. Nos. 4,569 106 to Lovato; 4,672,725 to Kasai; 4,688,337 to Dillner and Smous; 4,987,661 to Kasai; 5,131,122 to Lovato; 5,291,641 to Morino; and 5,438,737 and 5,459,910, both to Anscher.

All these prior art devices have a male plug member with one or two side catch arms, and a female socket member. When the male plug is inserted into the female socket, the catch arms engage openings in each side of the female socket, locking the male plug and female socket together. Disengagement is effected by pushing in the portions of the catch arms that protrude through the openings in the female socket.

Very few variations on the snap buckle incorporate an additional safety feature to prevent inadvertent or unwanted disengagement of the buckle.

The very nature of the snap buckle design makes it easy to disengage, and so an additional safety feature is important in situations where the buckle may be inadvertently disengaged, or where young children may try to disengage the buckle and put themselves at risk of injury. For example, snap buckles are often used to join child restraining straps in grocery carts and strollers. Inadvertent or deliberate disengagement by a young child is inconvenient at best, and at worst can be dangerous.

Three basic approaches have been taken in the prior art to incorporating an additional safety feature into a snap buckle:

The first approach, shown in U.S. Pat. Nos. 4,793,032 to Crowle, 4,825,515 to Wolterstorff, Jr., and 5,774,956 to French and Wigger, employs an additional catch to supplement either one or two side catch arms. The additional catch is incorporated into the male plug member and is accessible directly through an opening in the top of the female socket member. The catch arms and the additional catch are operated on simultaneously to disengage the male plug from the female socket.

A major disadvantage of the above devices, however, is that the additional catch cannot be easily disengaged, even when an adult may want to do so. For example, the additional catches of 4,793,032 and 5,774,956 must be fully depressed into the interior of the female socket to clear the socket and allow disengagement. The top socket opening cannot be made large enough to enable the catch to be easily disengaged by hand, since the catch's size (and thus the opening's size) is limited by the need to provide clearance to depress the side catch arms.

A further disadvantage is that in the engagement process, the additional catch must be depressed to enter the female socket, making engagement more difficult. The additional catch cannot protrude suitably out of the top socket opening (desirable for visibility and intuitiveness of operation), since the further it protrudes, the more difficult it is to engage and disengage the catch.

The additional catch shown in 4,825,515 is also cumbersome to disengage. It is small and not centrally located on the female socket, making it less intuitive for an adult to operate.

The second approach, shown in applicant's previous invention (Ser. No. 09/127135, filed Jul 31, 1998), also employs an additional catch to supplement either one or two catch arms. However, the additional catch of this invention is disengaged by pushing down on a hinged member located on the surface of the female socket. This approach has significant advantages over the first approach—the buckle is more difficult for a child to comprehend and operate, yet easier for an adult to operate; moreover, this second approach does not sacrifice the structural rigidity, aligning action and crush resistance that a rigid central member lends to a snap buckle.

The third approach to incorporating a safety feature into a snap buckle entails blacking the action of the side catch arms, thus preventing disengagement of the buckle. U.S. Pat. Nos. 4,912,950 to Crowle and 5,144,725 to Krauss employ locking assemblies within the female socket, which rotate to block the action of the side catch arms. The sockets of these devices are complex, entail multiple parts, and are difficult to manufacture in one piece. Engagement of the blocking action is not automatic upon insertion of the male plug into the female socket, and entails an additional locking step requiring a key or other similar tool. Further, it is difficult to unlock the side catch arms—unlocking the buckle also requires a key or other similar tool. This is more involved and less intuitive than, say, simply pushing a button to undo the blocking action and permit the side catch arms to be disengaged.

Thus it can be seen that a snap buckle with a blocking action that is easier for an adult to engage and disengage, yet still very difficult for a child to comprehend and operate, would be a significant improvement over the prior art.

Accordingly, several objects and advantages of the invention are:

The blocking action is easier and more intuitive for an adult to engage than prior art devices. The blocking action engages automatically when the male plug is inserted into the female socket. No additional engagement steps are needed, unlike the aforementioned prior art which requires an additional locking step.

The blocking action is also easier and more intuitive for an adult to disengage than prior art devices. It is much easier to simply depress a button to unblock the side catch arms than it is to use a key or similar tool to rotate a locking assembly out of the way of the side catch arms. Yet, it is difficult for a small child to comprehend and operate. The button on the top of the female socket must be pushed down before the side catch arms can be pushed in.

In addition, the blocking action does not affect the reversibility of the buckle—that is, the male plug can be inserted into the female socket in a "right-side-up" or "upside-down" position.

Finally, the female socket can be manufactured in one piece, thereby minimizing manufacturing steps and cost, unlike those prior art devices which use rotating locking assemblies.

Further objects and advantages of the invention will become apparent from a consideration of the drawings and ensuing description.

SUMMARY

The invention is a snap buckle with a safety feature—a blocking element which blocks the action of the side catch arms and prevents the buckle from being inadvertently disengaged. An adult can engage and disengage the blocking element more easily than in prior art devices.

DETAILED DESCRIPTION OF THE INVENTION

Figure 1:
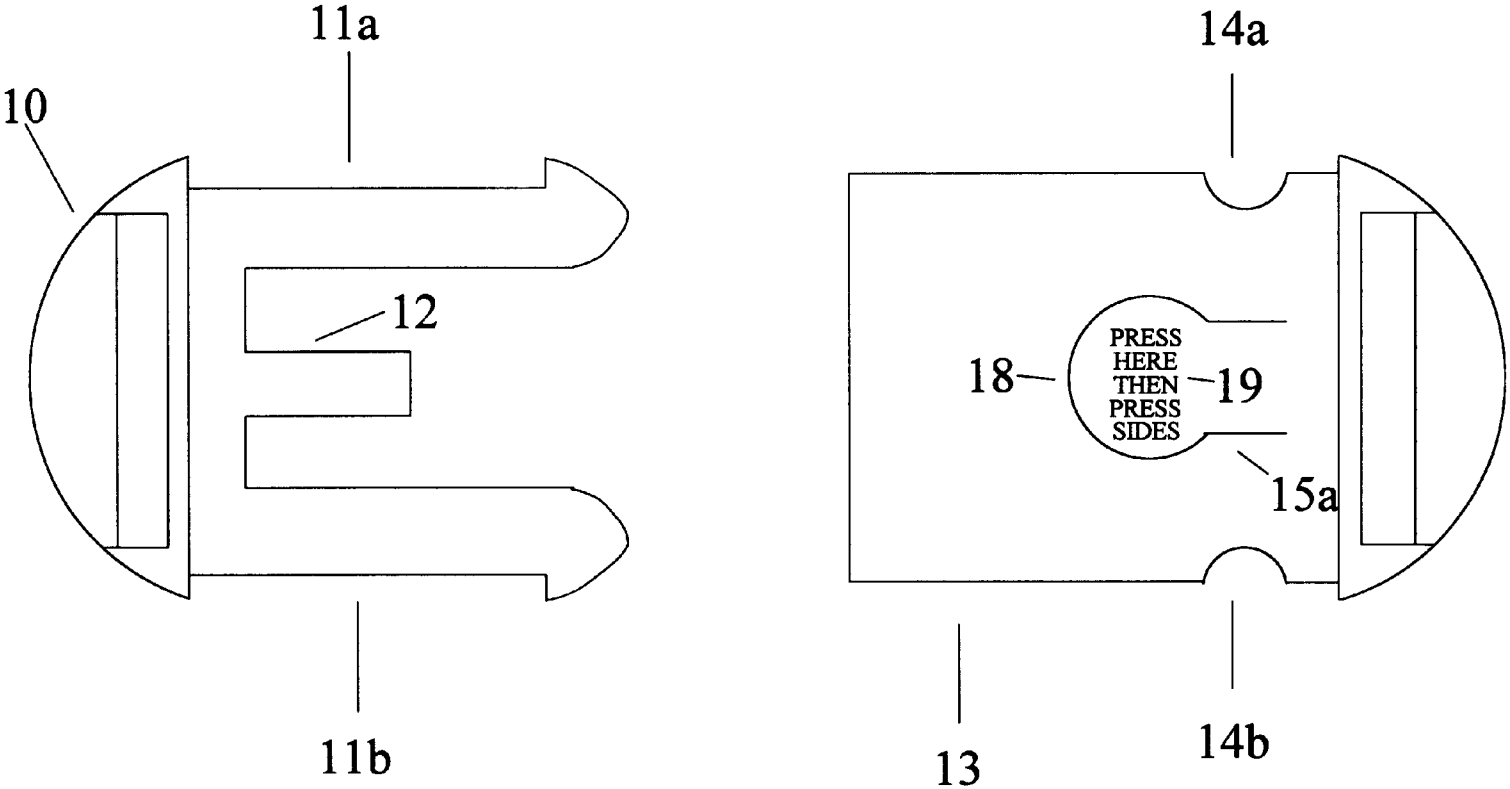
FIG. 1 is a top view of the male plug and female socket, prior to insertion of the plug into the socket.

The following provides a list of the reference characters used in the drawings:

| | |
|---|---|
| 10. | Plug |
| 11a&b. | Side catch arms |
| 12. | Central member |
| 13. | Socket |
| 14a&b | Openings |
| 15a&b. | Hinged members |
| 16a,b&c. | Blocking elements |
| 17. | Slot |
| 18. | Button |
| 19. | User instruction |
| 20. | Pull |
| 21. | Bevel |
| 22a&b. | Shelves (shown as "black box") |
| 23. | Central member catch (shown as "black box") |

Figure 2:
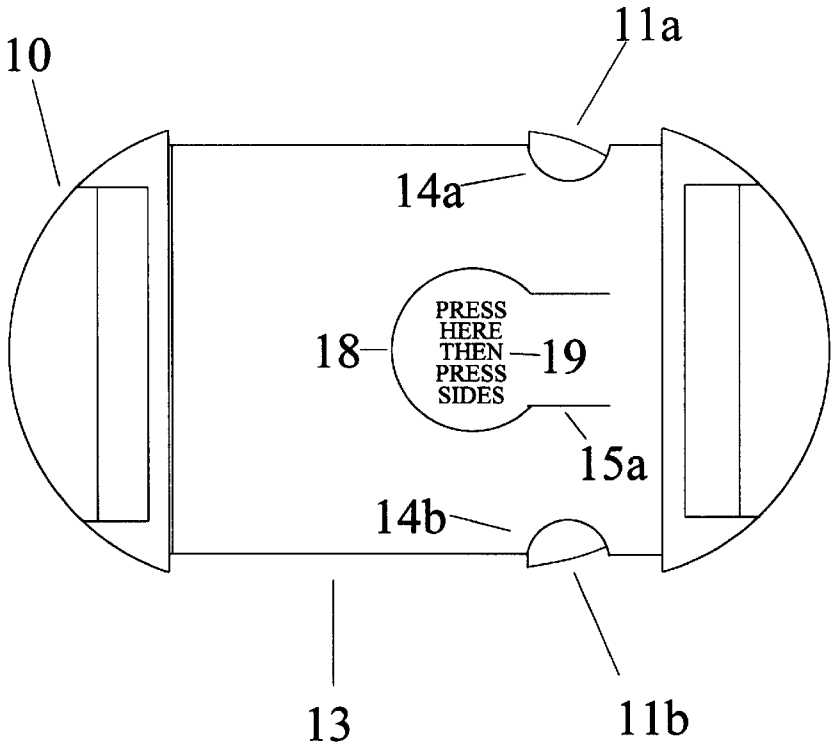
FIG. 2 is a top view of the buckle in a closed, engaged position.

FIGS. 1 & 2 are top views of the invention. A male plug 10 forms one part of the device. Said plug 10 has two resilient side catch arms 11*a*&*b,* and a central member 12.

A female socket 13 forms the other part of the device. Two openings 14*a*&*b* are located on the sides of socket 13. A resilient hinged member 15*a* forms an integral part of the front surface of socket 13, and extends along the lengthwise dimension of socket 13. Hinged member 15*a* also projects downward into the interior of socket 13.

Figure 3:
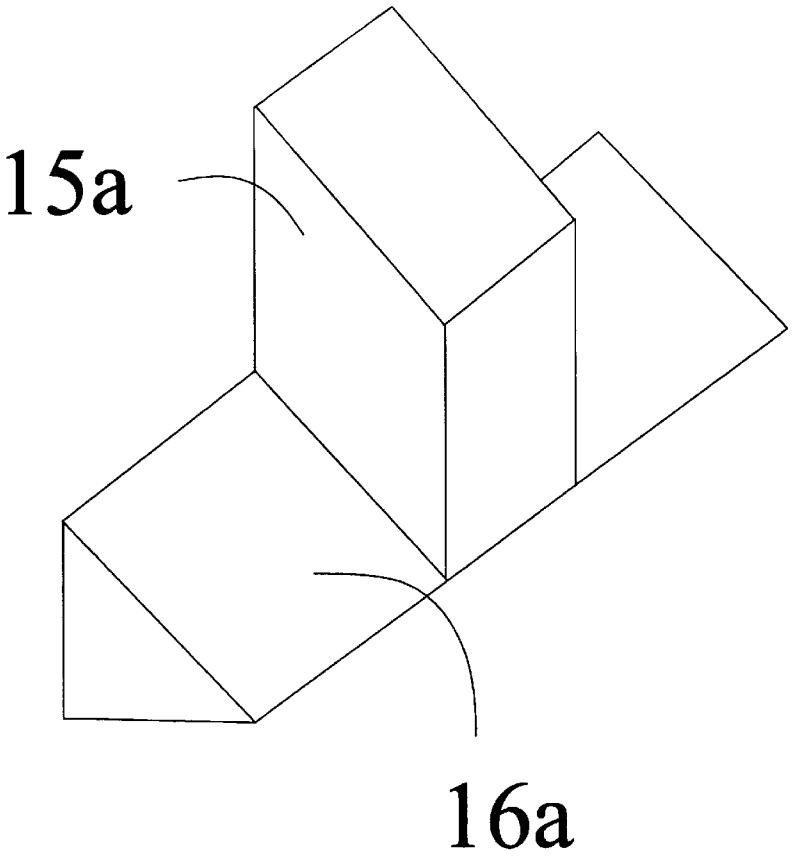
FIG. 3 is a detailed view of the blocking element.

A blocking element 16*a,* having a wedge-shaped cross section as detailed in FIG. 3, is located on the socket-interior end of hinged member 15*a,* said blocking element 16*a* extending laterally across the interior width of socket 13. A slot 17 in socket 13 is located below blocking element 16*a*. Slot 17 is suitably sized to allow blocking element 16*a* to pass through socket 13 when hinged member 15*a* is in a depressed position.

A button 18 is located on the outer surface of hinged member 15*a*. A user instruction 19, comprising the text "Press Here Then Press Sides", is also located on the outer surface of hinged member 15*a*.

Figure 4:
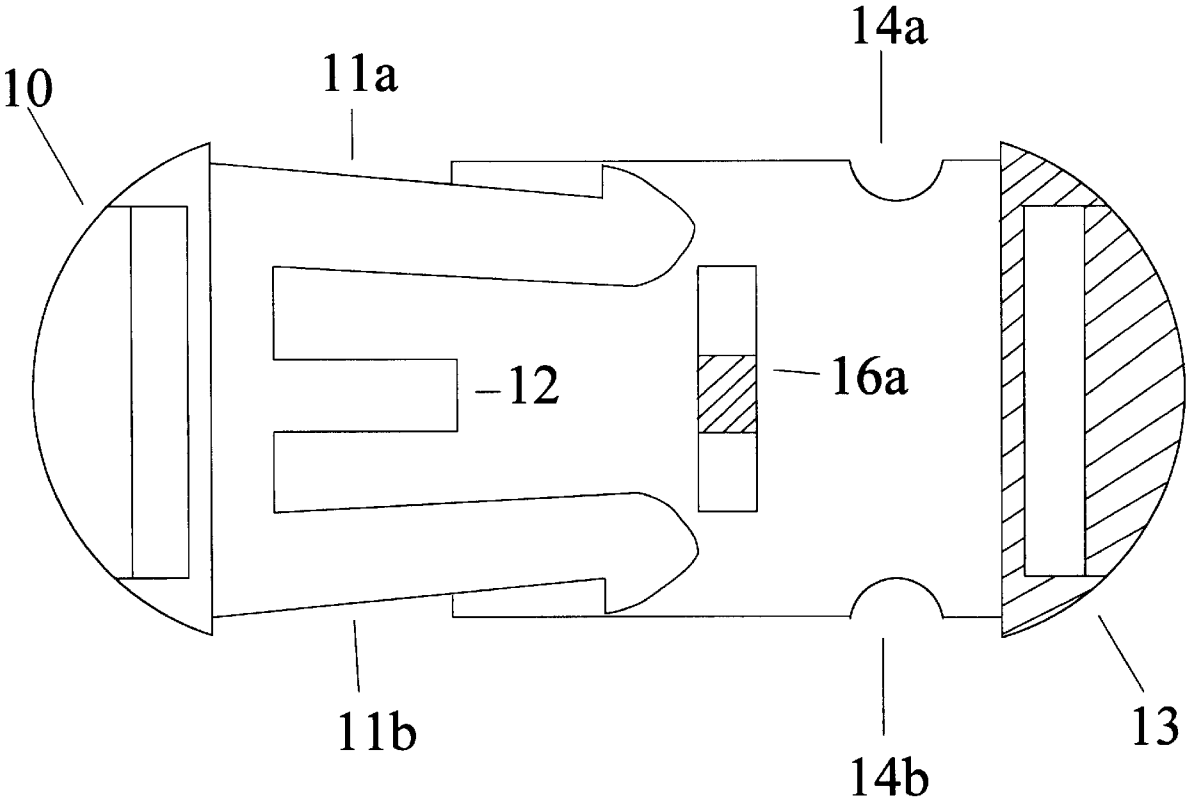
FIG. 4 is a top view, with appropriate portions of the socket cut away, of the side catch arms and the blocking element, just before contact between the side catch arms and the blocking element.
Figure 5:
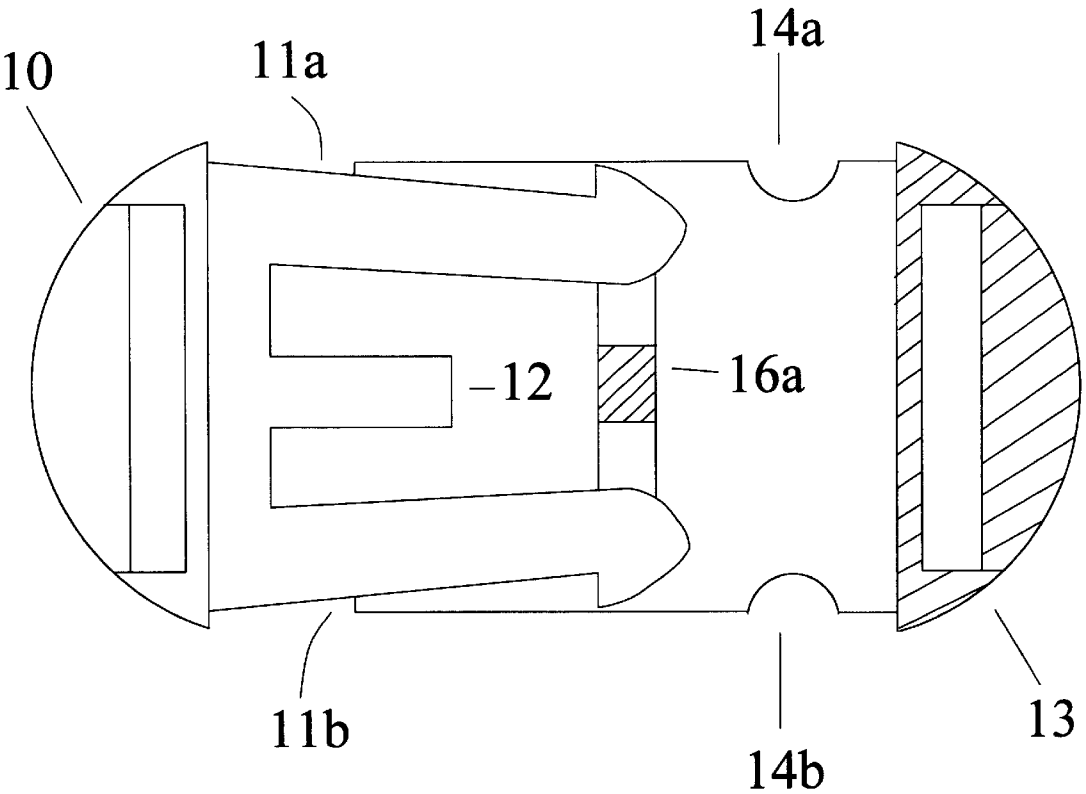
FIG. 5 is a top view, with appropriate portions of the socket cut away, of the side catch arms and the blocking element, as the side catch arms are riding over the blocking element.
Figure 6:
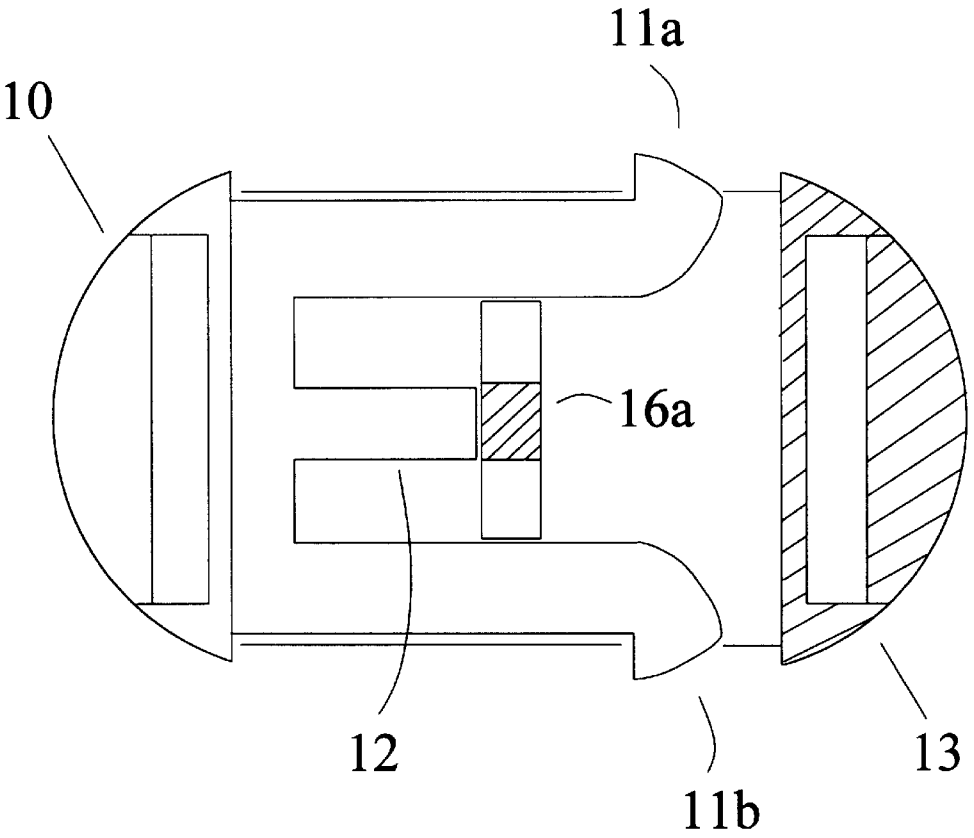
FIG. 6 is a top view, with appropriate portions of the socket cut away, of the side catch arms and the blocking element, with the side catch arms in an engaged and blocked position.
Figure 7:
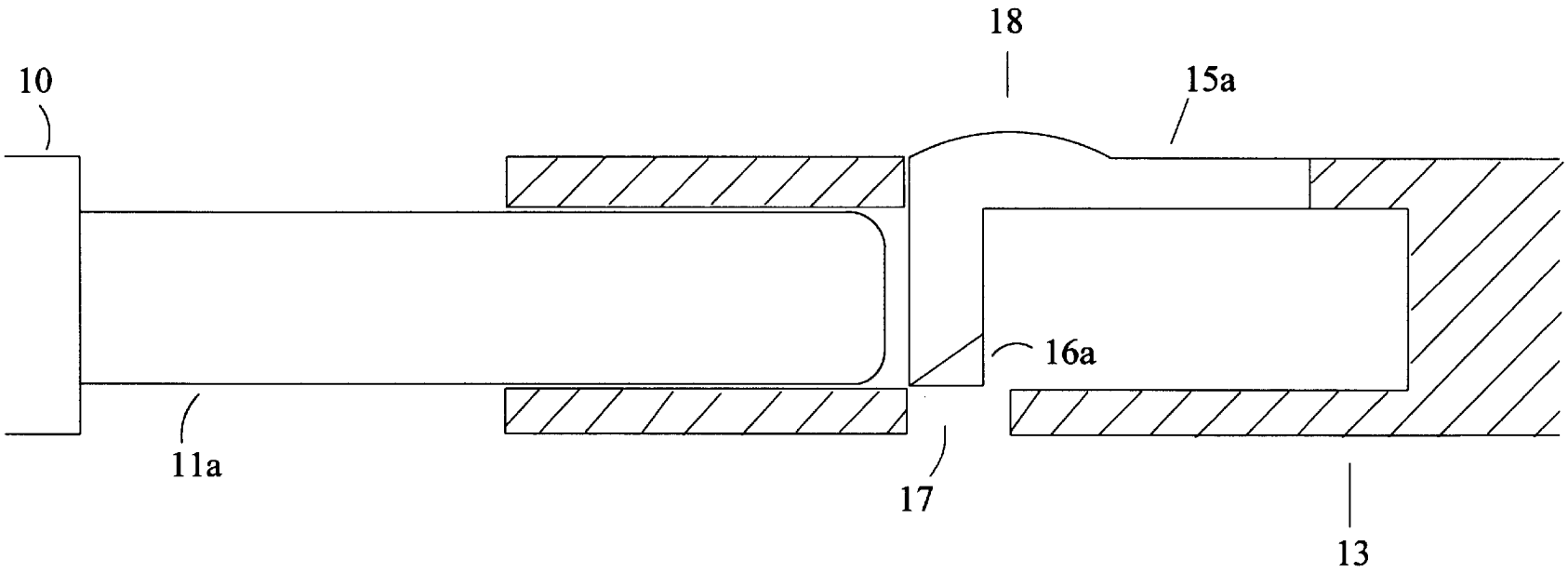
FIG. 7 is a side view, with appropriate portions of the socket cut away, of one side catch arm and the blocking element, just before contact between the side catch arm and the blocking element.
Figure 8:
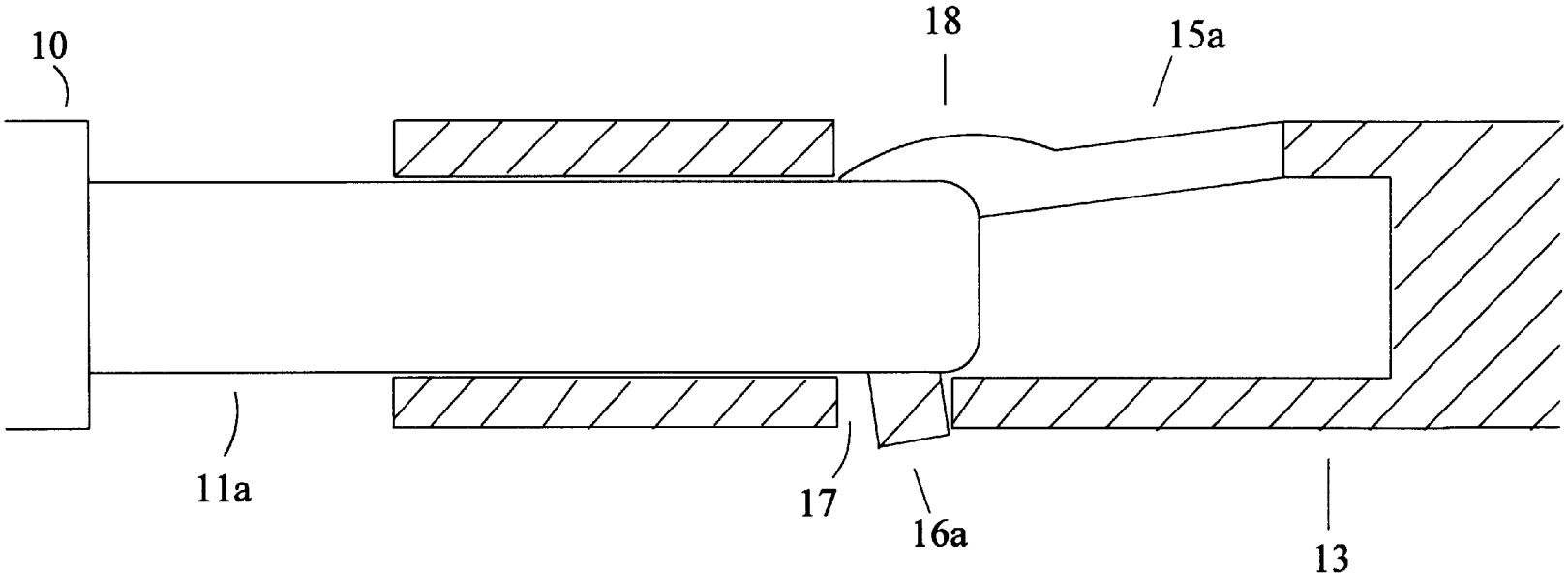
FIG. 8 is a side view, with appropriate portions of the socket cut away, of one side catch arm and the blocking element, as the side catch arm is riding over the blocking element.
Figure 9:
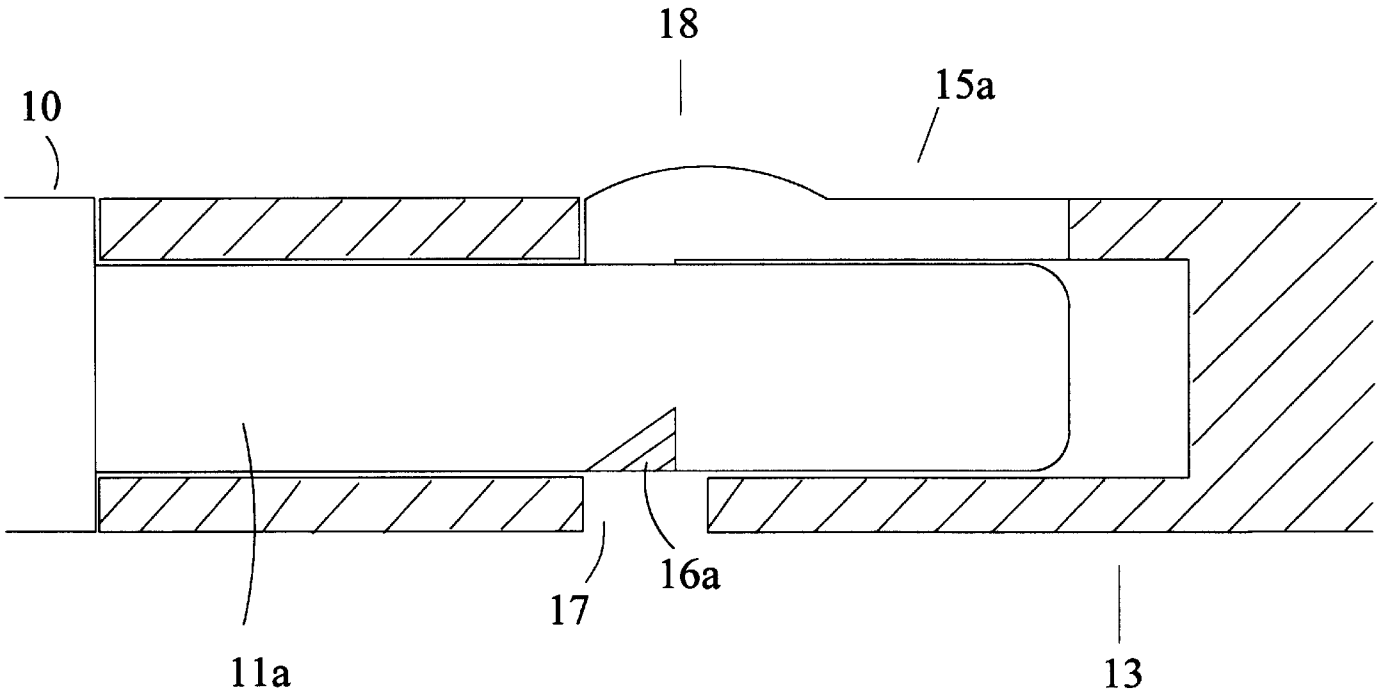
FIG. 9 is a side view, with appropriate portions of the socket cut away, of one side catch arm and the blocking element, with the side catch arm in an engaged and blocked position.

FIGS. 4–6 provide sequential cutaway top views of the buckle engagement process, and FIGS. 7–9 provide sequential cutaway side views of the buckle engagement process.

To engage the device, plug 10 is inserted into the open end of socket 13, and said plug 10 and socket 13 are urged together. During the insertion process, side catch arms 11*a*&*b* are urged together by the inner surfaces of socket 13, and said side catch arms 11*a*&*b* eventually contact blocking element 16*a*. The wedge-shaped cross section of blocking element 16*a* allows side catch arms ll*a*&*b* to ride over blocking element 16*a,* urging blocking element 16*a* into slot 17. After side catch arms 11*a*&*b* have ridden over blocking element 16*a,* said side catch arms 11*a*&*b* spring outward into openings 14*a*&*b*. Hinged member 15*a* and blocking element 16*a* spring back to their non-depressed positions. Side catch arms 11*a*&*b* are now in an engaged position, and their disengagement is blocked by blocking element 16*a*.

Figure 10:
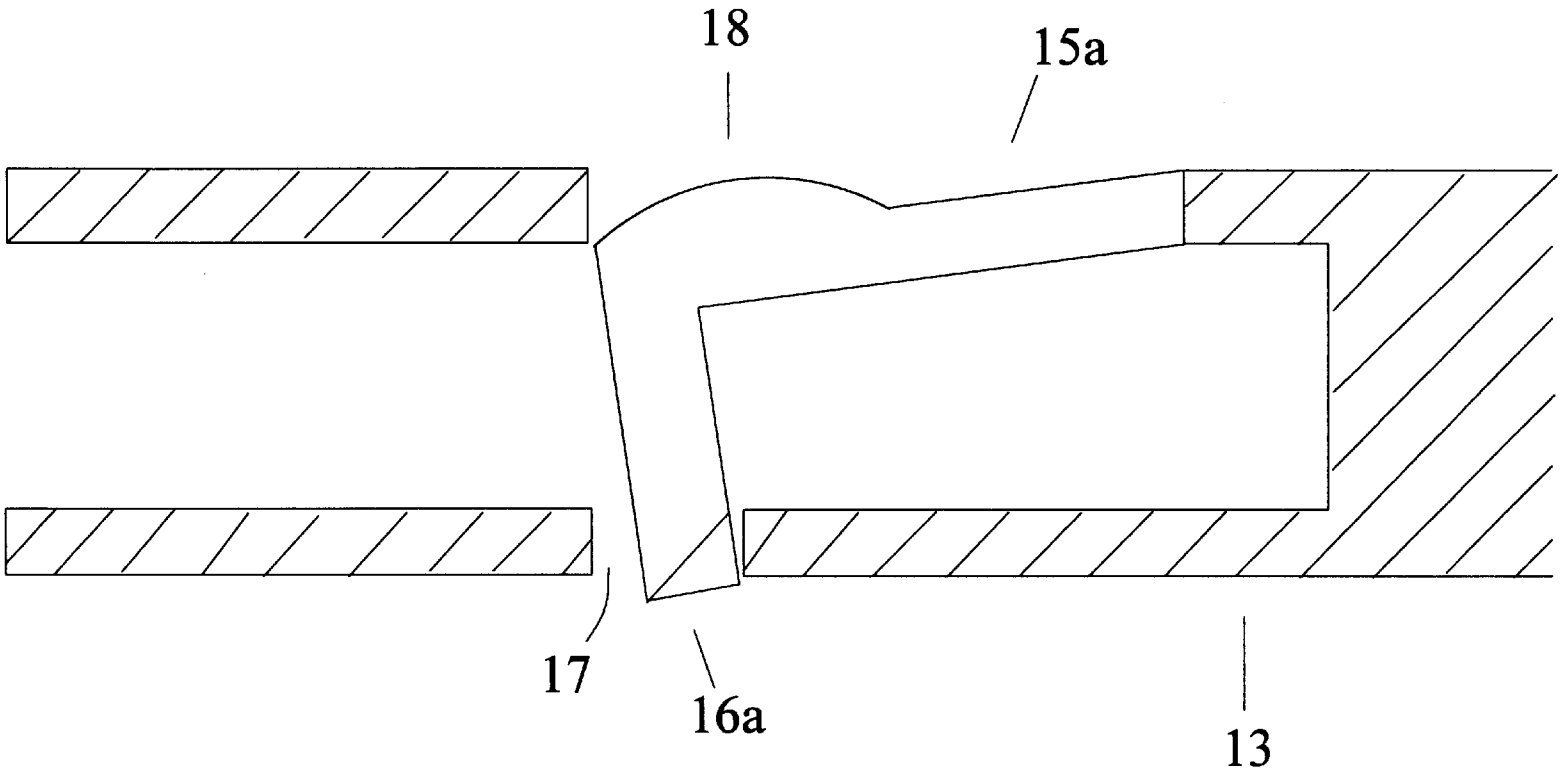
FIG. 10 is a side view of the socket only, with appropriate portions cut away, showing the blocking element in a depressed position wherein the action of the side catch arms would not be blocked.

To disengage the buckle, hinged member 15*a* is depressed at button 18, urging blocking element 16*a* downward into slot 17, as shown in FIG. 10. Side catch arms 11*a*&*b* are then pushed inward toward the interior of socket 13, allowing said side catch arms 11*a*&*b* to disengage from socket 13. Plug 10 may then be separated from socket 13.

Figure 11:
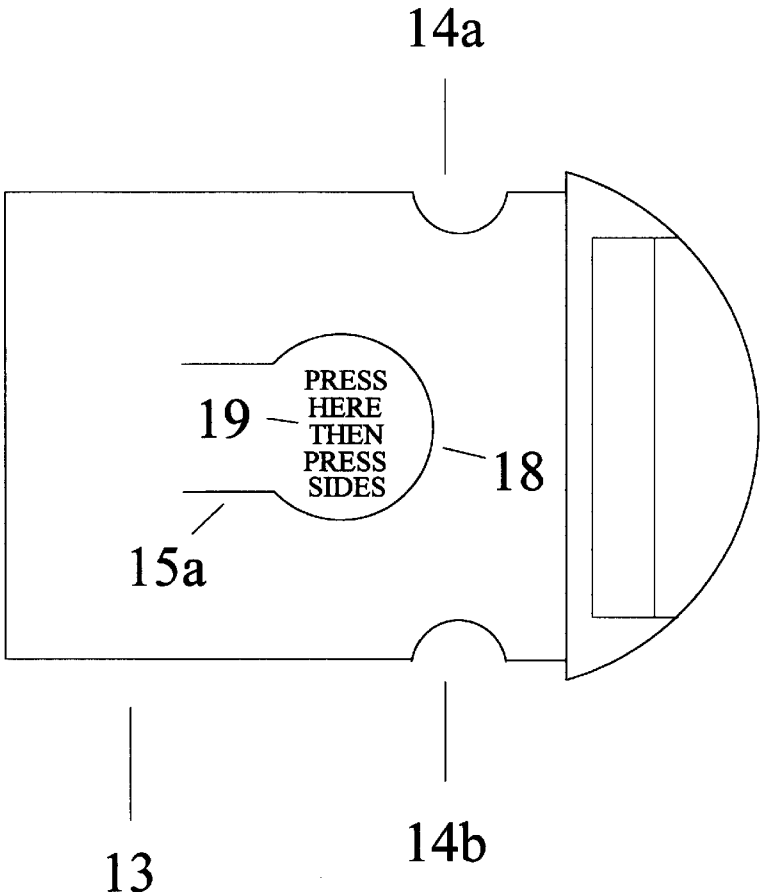
FIG. 11 illustrates an alternative embodiment wherein the hinged member extends from the open end of the female socket, rather than from the closed end as in the main embodiment.

Alternative embodiments are illustrated in FIGS. 11–16, and are detailed below:

As shown in FIG. 11, hinged member 15*a* can extend along the surface of socket 13 from the open end of socket 13, rather than from the closed end of socket 13 as in the main embodiment.

Figure 12:
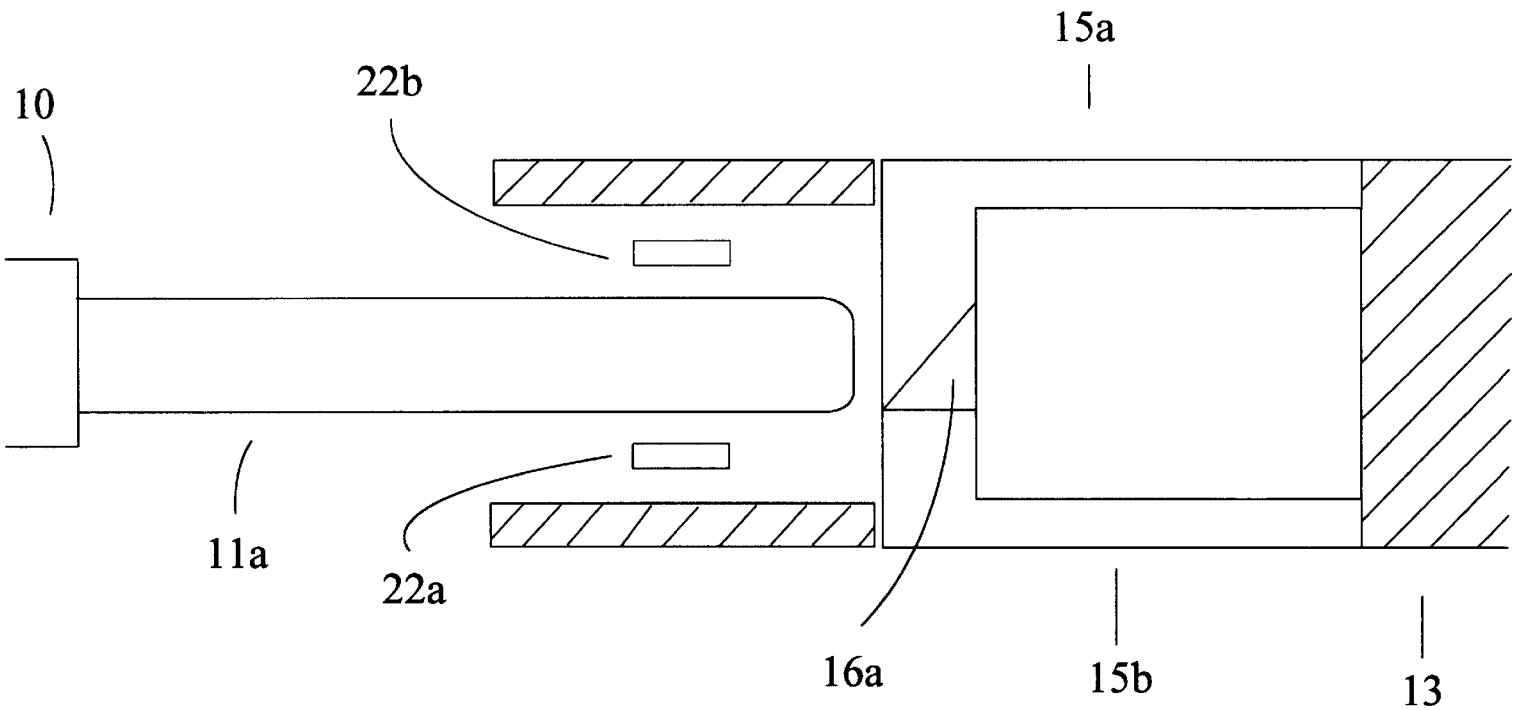
FIG. 12 illustrates an alternative embodiment having hinged members located on both the front and back sides of the buckle, whereby the blocking element can be moved to a non-blocking position by pressing either hinged member.

As shown in FIG. 12, hinged members 15*a*&*b* can be located on, respectively, the front and back surfaces of socket 13, and a blocking element 16*a* can be connected to both hinged members 15*a*&*b,* such that pressure on either hinged member 15*a* or 15*b* would move blocking element 16*a* out of a blocking position. Blocking element 16*a* would move to a non-blocking position either above or below side catch arms 11*a*&*b,* depending on whether pressure is applied to hinged member 15*a* or 15*b*. Shelves 22*a*&*b,* shown in FIG. 12 as "black boxes", position and hold side catch arm 11*a* above the floor of socket 13.

Figure 13:
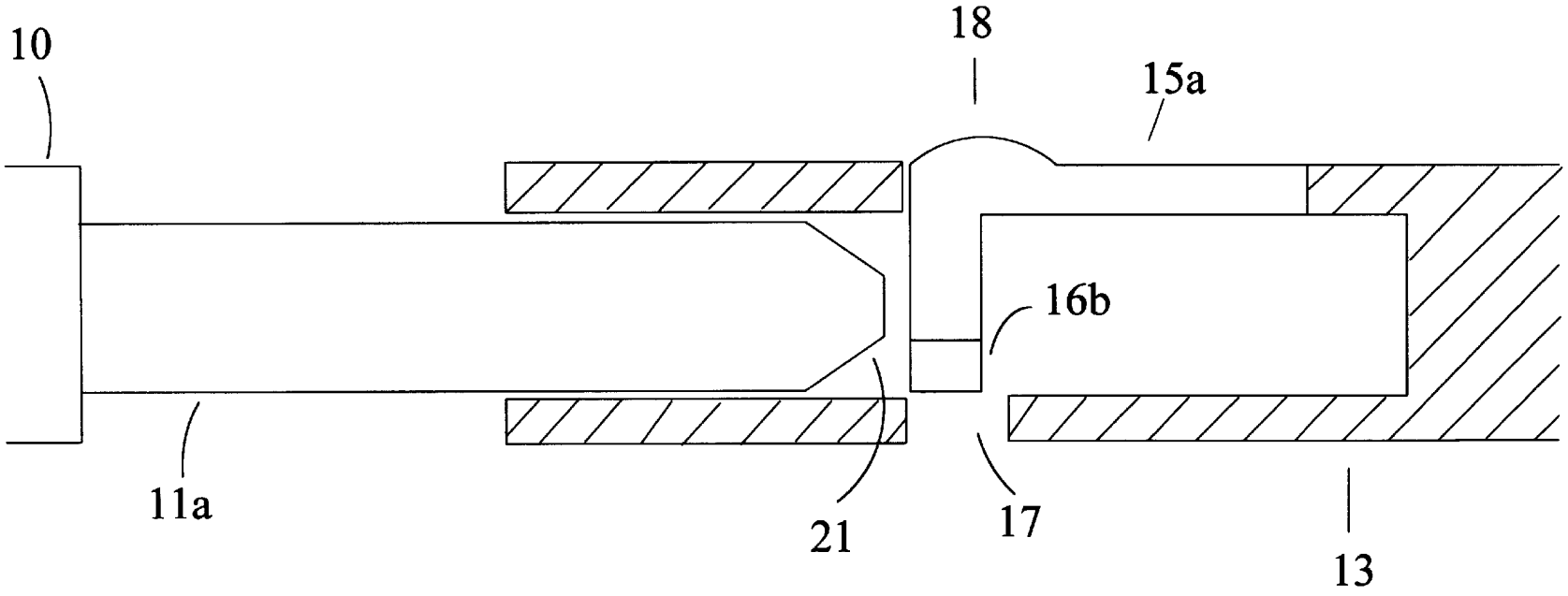
FIG. 13 illustrates an alternative embodiment, wherein the blocking element has a rectangular-shaped cross section, and the leading edges of the side catch arms are beveled in order to ride easily over the blocking element.

As shown in FIG. 13, the wedge-shaped cross section seen in blocking element 16*a* can be eliminated, and a blocking element 16*b* with a rectangular-shaped cross section can be substituted. However, this might negate the automatic engagement feature of the buckle (depending on whether the leading edges of side catch arms 11*a*&*b* were suitably beveled or rounded), and necessitate that hinged member 15*a* be pressed down while engaging the buckle. To avoid this, as also shown in FIG. 13, the leading edge of side catch arms 11*a*&*b* can be suitably beveled or rounded to allow said side catch arms 11*a*&*b* to ride over blocking element 16*b*.

Figure 14:
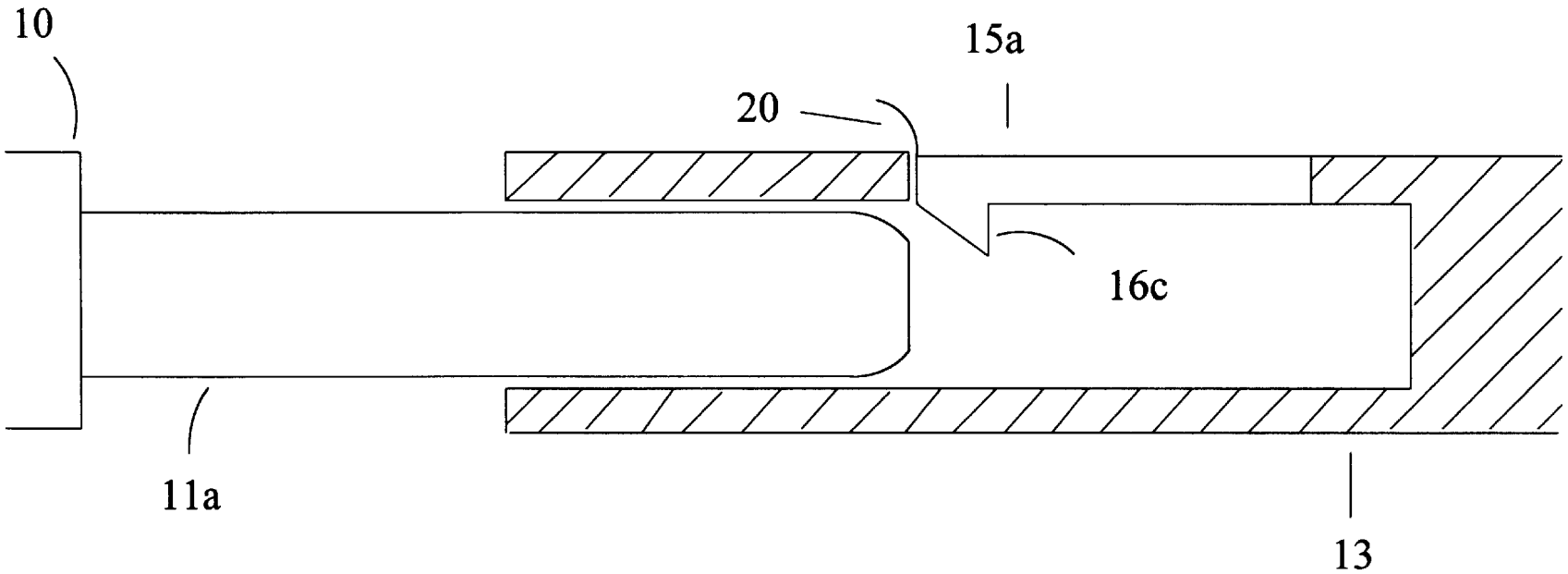
FIG. 14 illustrates an alternative embodiment with a pull located on the hinged member, such that the blocking element can be pulled to a non-blocking position.

As shown in FIG. 14, a pull 20 or other pulling means can be attached to a blocking element 16*c,* such that blocking element 16*c* can be pulled rather than pushed to a non-blocking position.

Figure 15:
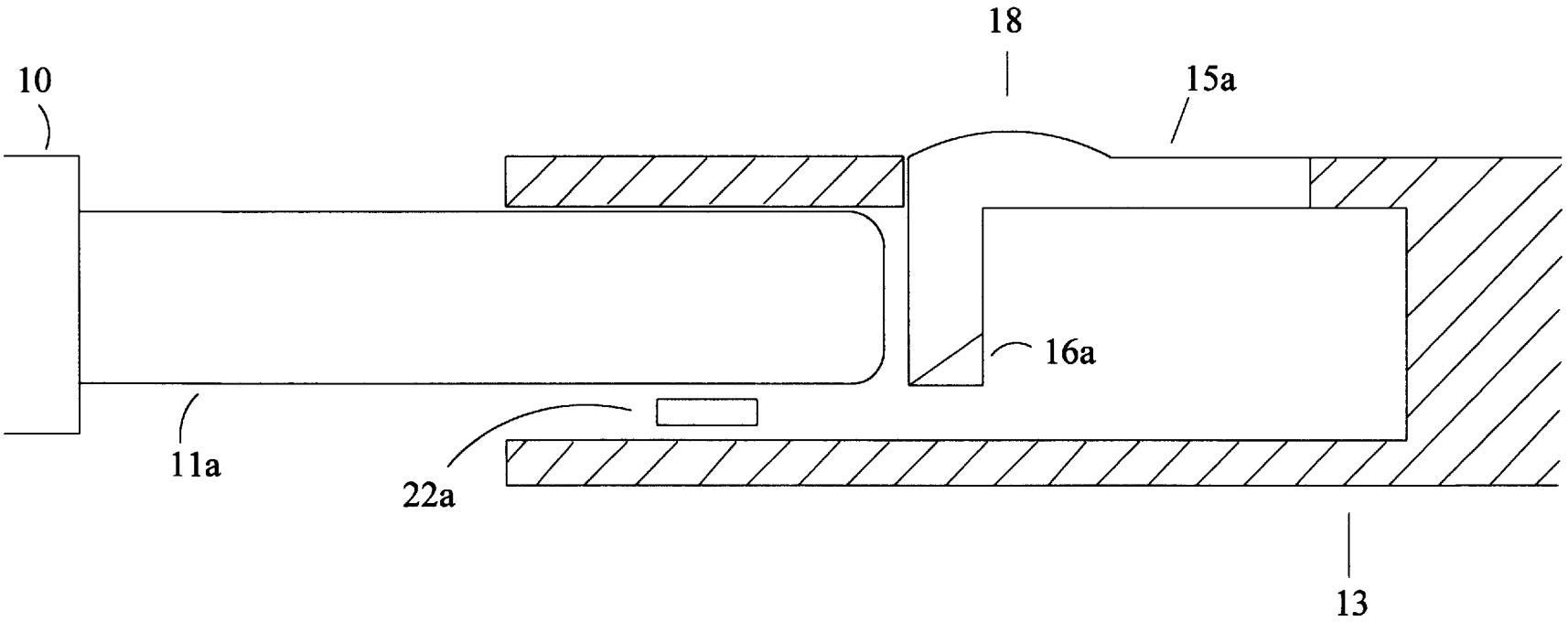
FIG. 15 illustrates an alternative embodiment wherein the female socket fully contains the blocking element, thus eliminating the need for a slot in the socket.

As shown in FIG. 15, slot 17 can be eliminated if socket 13 is made sufficiently thick to fully contain blocking element 16*a* as side catch arms 11*a*&*b* ride over it during engagement of the buckle, and as hinged member 15*a* is depressed during disengagement of the buckle. Shelf 22*a,* shown in FIG. 15 as a "black box", is employed to position and hold side catch arm 11*a* above the floor of socket 13.

Figure 16:
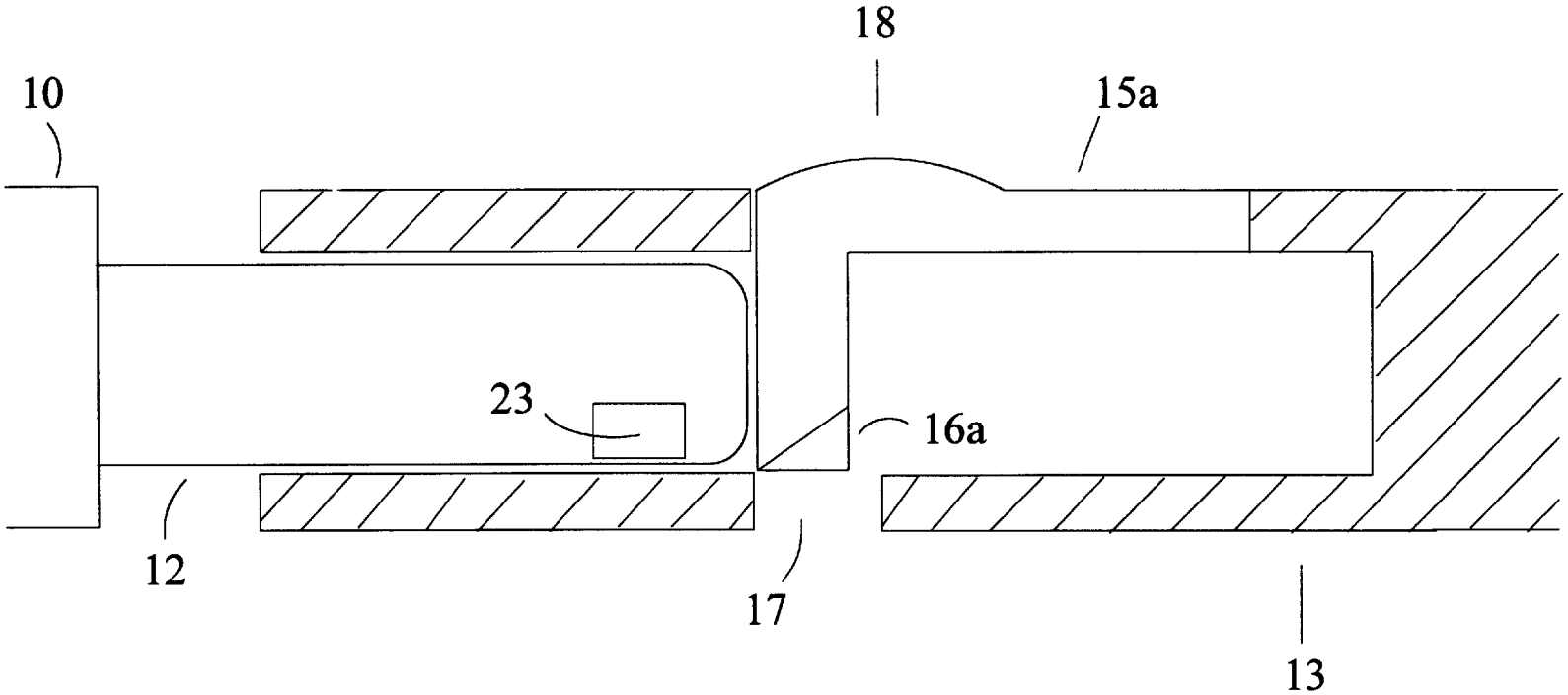
FIG. 16 illustrates an alternative embodiment with an additional catch located on the end of the central member, said additional catch engageable with the blocking element.

As shown in FIG. 16, an additional central member catch 23, shown in FIG. 16 as a "black box", can be located on the end of central member 12. Said central member catch 23 engages the wedge-shaped surface of blocking element 16*a* when the buckle is in a closed, engaged position, increasing the rigidity of the buckle and its strength under load.

Thus the reader will see that this invention is very effective at preventing the inadvertent or unwanted release of a snap buckle by a small child, yet it is easy for an adult to operate. The safety feature which blocks the action of the side catch arms engages automatically, and disengagement can be accomplished quickly and easily by an adult.

While the above descriptions contain many specificities, these shall not be construed as limitations on the scope of the invention, but rather as exemplifications of embodiments thereof. Many other variations are possible. Examples of just a few of the possible variations follow:

The length of the hinged member along the surface of the socket can be different. The hinged member must be suitably long so that the resiliency of the material allows sufficient downward movement to allow the blocking element to move down into the slot during engagement and disengagement of the buckle. In addition, the width of the hinged member can be different, as long as sufficient clearance exists for the operation of the side catch arms.

The hinged member can be formed apart from the socket, and attached to the socket with a spring-action hinge, rather than integrally formed with the socket as in the main embodiment (multiple-piece construction, instead of one-piece construction). The hinged member can be located on the back surface of the socket, facing toward the object being strapped in, rather than on the front surface of the buckle as in the main embodiment.

The blocking element can be differently shaped, such that a portion of it extends into the slot even when the hinged member and blocking element are in non-depressed positions. This would lend added stability to the buckle. However, for automatic engagement, the wedge-shaped surface of the blocking element must be sufficiently present to allow the side catch arms to ride over the blocking element. Additionally, grooves or other guiding means can be employed to position and hold the side catch arms above the floor of the socket.

The slot can have a different size or shape, as long as it is sufficiently sized and shaped to allow the blocking element to pass through the socket during engagement and disengagement of the buckle. The button can be of various sizes and shapes, and may be located differently on the hinged member. The button can also be eliminated, to make it more difficult for a small child to comprehend the buckle's principles of operation. Additionally, the central member can be eliminated.

The user instruction can be comprised of different text, or can be eliminated. A supplementary user instruction, directing the user to the hinged member, can also be located on the surface of the buckle that doesn't have the hinged member.

Finally, the buckle can have only one side catch arm, instead of two.

Accordingly, the scope of the invention should be determined not by the embodiments illustrated, but by the appended claims and their legal equivalents.

I claim:

1. A buckle, comprising:

(a) a male part having catching means, and (b) a female part having at least one hinged member located thereon, and having an open end, a front surface, and a back surface, and (c) a blocking element, associated with said hinged member, that blocks the disengagement of said catching means, whereby disengagement of said male part from said female part requires separate and independent pressure on said depressible member and said catching means.

2. The device of claim 1, wherein said catching means comprise one catch arm.

3. The device of claim 1, wherein said catching means comprise two catch arms.

4. The device of claim 1, wherein said female part has a closed end, and said hinged member extends from said closed end of said female part.

5. The device of claim 1, wherein said hinged member extends from said open end of said female part.

6. The device of claim 1, wherein one said hinged member is located on said front surface of said female part.

7. The device of claim 1, wherein one said hinged member is located on said back surface of said female part.

8. The device of claim 1, wherein one said hinged member is located on said front surface of said female part, and one said hinged member is located on said back surface of said female part.

9. The device of claim 1, wherein said blocking element has an elongated shape with a wedge-shaped cross section.

10. The device of claim 1, wherein said blocking element has an elongated shape with a rectangular-shaped cross section.

11. The device of claim 1, wherein said female part has a slot located thereon, and said blocking element projects into said slot during engagement and disengagement of said male part and said female part.

12. The device of claim 1, wherein said blocking element is fully contained within said female part during engagement and disengagement of said male part and said female part.

13. The device of claim 1, wherein said male part has a central member spaced laterally apart from said catching means.

14. The device of claim 13, wherein an additional catch is located on the end of said central member, said additional catch engaging a wedge-shaped surface of said blocking element during engagement of said male part and said female part.

15. The device of claim 1, wherein indicating means are located on at least one said hinged member, thereby facilitating optimal pressure application on said hinged member.

16. The device of claim 15, wherein said indicating means comprise a button.

17. The device of claim 15, wherein said indicating means describe the operation of the buckle.

18. The device of claim 1, wherein at least one said hinged member and said female part are formed together, of one-piece construction.

19. The device of claim 1, wherein at least one said hinged member and said female part are formed apart, of multiple-piece construction.

20. The device of claim 1, wherein pulling means are associated with said blocking element, and said pulling means can be pulled to exert pressure on said blocking element and said hinged member, thereby moving said blocking element to a position wherein disengagement of said catching means is not blocked.

* * * * *

UNITED STATES PATENT AND TRADEMARK OFFICE

CERTIFICATE OF CORRECTION

PATENT NO. : 6,138,330
DATED : October 31, 2000
INVENTOR(S) : John Alexander Galbreath It is certified that error appears in the above-identified patent and that said Letters Patent is hereby corrected as shown below:

Title Page,
Item [76], inventor: should read -- John Alexander Galbreath, Reistertown, Maryland --

Signed and Sealed this

Ninth Day of October, 2001

*Attest:*

Nicholas P. Godici

*Attesting Officer*

NICHOLAS P. GODICI
*Acting Director of the United States Patent and Trademark Office*